United States Patent [19]

Riolland

[11] 4,386,574

[45] Jun. 7, 1983

[54] SAIL ASSEMBLY OF VARIABLE PROFILE, REVERSIBLE AND COLLAPSIBLE

[76] Inventor: Pierre L. Riolland, 15205 Peacock Hill Ave., Gig Harbor, Wash. 98335

[21] Appl. No.: 331,010

[22] Filed: Dec. 15, 1981

[51] Int. Cl.[3] ..... B63H 9/06

[52] U.S. Cl. ..... 114/103; 244/219

[58] Field of Search ..... 114/39, 102, 103; 244/219

[56] References Cited

U.S. PATENT DOCUMENTS

| | | | |
|---|---|---|---|
| 1,890,059 | 12/1932 | Lafe | 244/219 |
| 3,580,203 | 5/1971 | Martin | 114/102 |
| 4,064,821 | 12/1977 | Roberts, Jr. et al. | 114/102 |
| 4,341,176 | 7/1982 | Orrison | 114/102 |

FOREIGN PATENT DOCUMENTS

| | | | |
|---|---|---|---|
| 319138 | 5/1931 | Fed. Rep. of Germany | 114/102 |
| 549141 | 2/1923 | France | 244/219 |
| 574500 | 7/1924 | France | 244/219 |
| 574803 | 7/1924 | France | 244/219 |
| 30075 | 1/1926 | France | 244/219 |
| 675207 | 2/1930 | France | 244/219 |
| 889560 | 1/1944 | France | 244/219 |
| 922899 | 6/1947 | France | 244/219 |
| 568209 | 3/1945 | United Kingdom | 114/102 |

*Primary Examiner*—Trygve M. Blix
*Assistant Examiner*—Jesús D. Sotelo
*Attorney, Agent, or Firm*—Bacon & Thomas

[57] ABSTRACT

A sail assembly of variable profile, reversible and collapsible, comprising a mast on which are mounted ribs set apart one from the other, each one being constituted of two flexible laths joined together by hinge members, the ribs being covered with a supple material, such as for example sail cloth. Each rib includes a slide piece on which are pivotally mounted the two flexible laths and on which a mast is slidably mounted, the mast being fast in rotation with the slide and being adapted to be driven in rotation, the slide piece being provided at the back with a first cam which is fast with a shaft driven in rotation and comprising two arms connected together by transmission members pivotally mounted on the rear portion of the flexible laths. The invention finds an application in the production of sail assemblies of variable profile.

5 Claims, 8 Drawing Figures

SAIL ASSEMBLY OF VARIABLE PROFILE, REVERSIBLE AND COLLAPSIBLE

The present invention relates to a sail assembly of variable profile, reversible and collapsible.

It is known to produce sails for ships and land vehicles, which have an aerodynamical profile similar to that of aircraft wings, and of which the profile can be altered in relation to the force of the wind. This arrangement contributes to increasing substantially the performances of the crafts using the propelling force of the wind by improving the aerodynamical qualities over the existing conventional sails.

These sails comprise a mast on which are mounted ribs, at a distance one from the other, each of said ribs being constituted of two flexible laths joined together by means of hinge members, the said ribs being covered with a supple material such as sail cloth.

However, a number of these devices of sails with variable profile have complicated means of control requiring for example, the use of cables moving on girders.

Other known devices only propose means which permit modifying the part of the ribs which is situated at the back of the sails.

The sail assembly according to the invention is designed to overcome the aforesaid drawbacks and to improve the profile yet further.

According to the present invention, each rib comprises a slide piece on which the two laths are pivotally mounted and on which a mast is slidably mounted, said mast being fast in rotation with said slide and being adapted to be driven in rotation, the said slide piece being provided at the back with a first cam which is fast with a shaft driven in rotation and which comprises two arms connected by transmission members pivotally mounted on the rear portion of the flexible laths, said slide piece being provided at the front with a second cam which is fast with a shaft driven in rotation and which comprises two arms connected by small rods to the pivoting axles of the flexible laths on the slide piece, and said slide piece being joined at the front by way of a tension rod to a pivoting point on the front part of the two flexible laths.

The fact of using two cams acting either separately or together on the ribs of the sail assembly, makes it possible to obtain a great number of profiles and in particular profiles giving the best performances.

It is also possible to alter the profile of the ribs by altering the tension of the tension rod and the dimensions of the small rods without having to change sails. The device enables to obtain advantages in races and to adapt the sails and their profile to the force of the wind, and even to stop the ship in full wind by setting the sails as a weathercock. Finally, due to the simplicity of the device according to the invention, the control of the rotary mast and of the cam shafts can easily be mechanized.

The simple design of the device according to the invention also permits the construction of large sails, for example for freighters, and the use of a non-rigged mast.

The invention will be more readily understood on reading the following description with reference to the accompanying drawings, in which.

Figure 1:
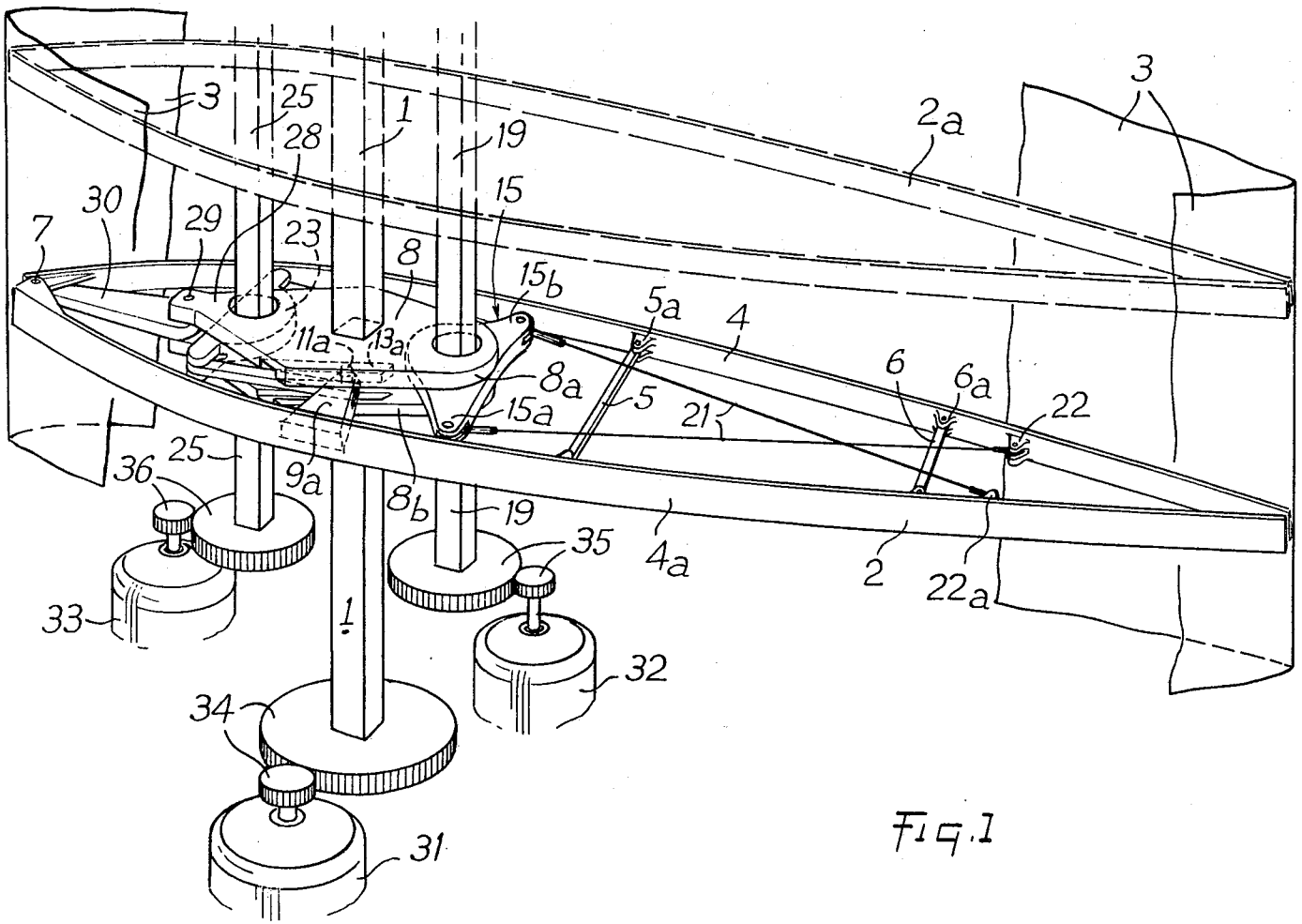
FIG. 1 is a perspective view of an improved sail assembly according to the invention.

FIG. 1 shows an embodiment of the sail assembly according to the invention which comprises a mast 1 mounted for rotating by its base inside the hull of the ship, on which mast is mounted the sail assembly, said mast 1 supporting ribs 2, 2a set apart one from the other and covered with a supple material 3, such as for example a sail cloth. Each rib, such as 2, shown in FIGS. 1 and 2, comprises two flexible laths 4, 4a joined together at the back by small rods 5 and 6 mounted for pivoting on the laths 4, 4a about pivot pins 5a, 6a and 5b, 6b. At the fore end of the rib, the laths 4, 4a are joined together by a pivoting axle 7.

Each rib comprises a slide piece 8 provided with a quadrangular hole in which is slidably mounted the mast 1, said mast 1 being fast in rotation with said slide piece and having a cross-section corresponding to the quadrangular hole of said slide piece. On either side of the slide piece 8 (FIGS. 1, 2, 3) the laths 4, 4a are provided in their middle part with two lugs 9, 9a on which are mounted axles 10, 10a, each one bearing two runners 11, 12 and 11a, 12a engaged in two pairs of grooves 13, 14 and 13a, 14a provided in the side edges of the slide piece 8 on either side of its longitudinal axis. Thus, the laths 4, 4a are guided in relation to the slide piece 8 with which they are fast.

At the rear end of the slide piece 8, said latter presents a fork, between the branches 8a, 8b of which is mounted a cam 15 by way of a sleeve 16 of quadrangular cross-section (FIGS. 4, 5, 6, 7, 8) which sleeve is mounted for rotation in circular holes 17, 17a of the branches 8a, 8b of the slide piece, and is fast in rotation with the cam 15 which presents a quadrangular hole 18 corresponding to the cross-section of the sleeve inside which it is engaged.

The sleeve 16 rests by way of a flange 16a on the upper face of the branch 8a of the slide piece.

Inside the sleeves 16 which correspond to the different ribs 2, 2a is mounted a shaft 19 of quadrangular cross-section (FIGS. 4, 5, 6, 7, 8) which shaft is provided to drive in rotation the said sleeves and by way of consequence, the cams 15.

Each cam 15 has two arms 15a, 15b on which rods 21, 21a are mounted for pivoting about axles 20, 20a, said rods being connected to the rear part of the laths 4, 4a by hinge pins 22, 22a. At the fore end of the slide piece 8 a cam 23 is mounted between the branches of a fork 28 provided in said slide piece, as shown and described in reference to the cam 15. Said cam 23 is mounted for rotating in the slide piece 8 by means of a sleeve 24 which is identical to the sleeve 16 and in which is engaged a shaft 25 driving the sleeve 24 and the cam 23 in rotation.

The cam 23 has two arms 23a, 23b on which small rods 27, 27a are mounted for pivoting at one of their ends about axles 26, 26*a*, said small rods being mounted for pivoting at their other end about axles 10, 10*a* sliding in grooves 13, 14 and 13*a*, 14*a* of the slide piece 8.

At the fore end of the fork 28 of the slide piece 8, a tension rod 30 is mounted for pivoting at one of its ends about an axle 29, said tension rod being mounted for pivoting at its other end about an axle 7 connecting the front ends of the laths 4, 4*a*.

Figures 2, 3, 4, 5, 6, 7, 8:
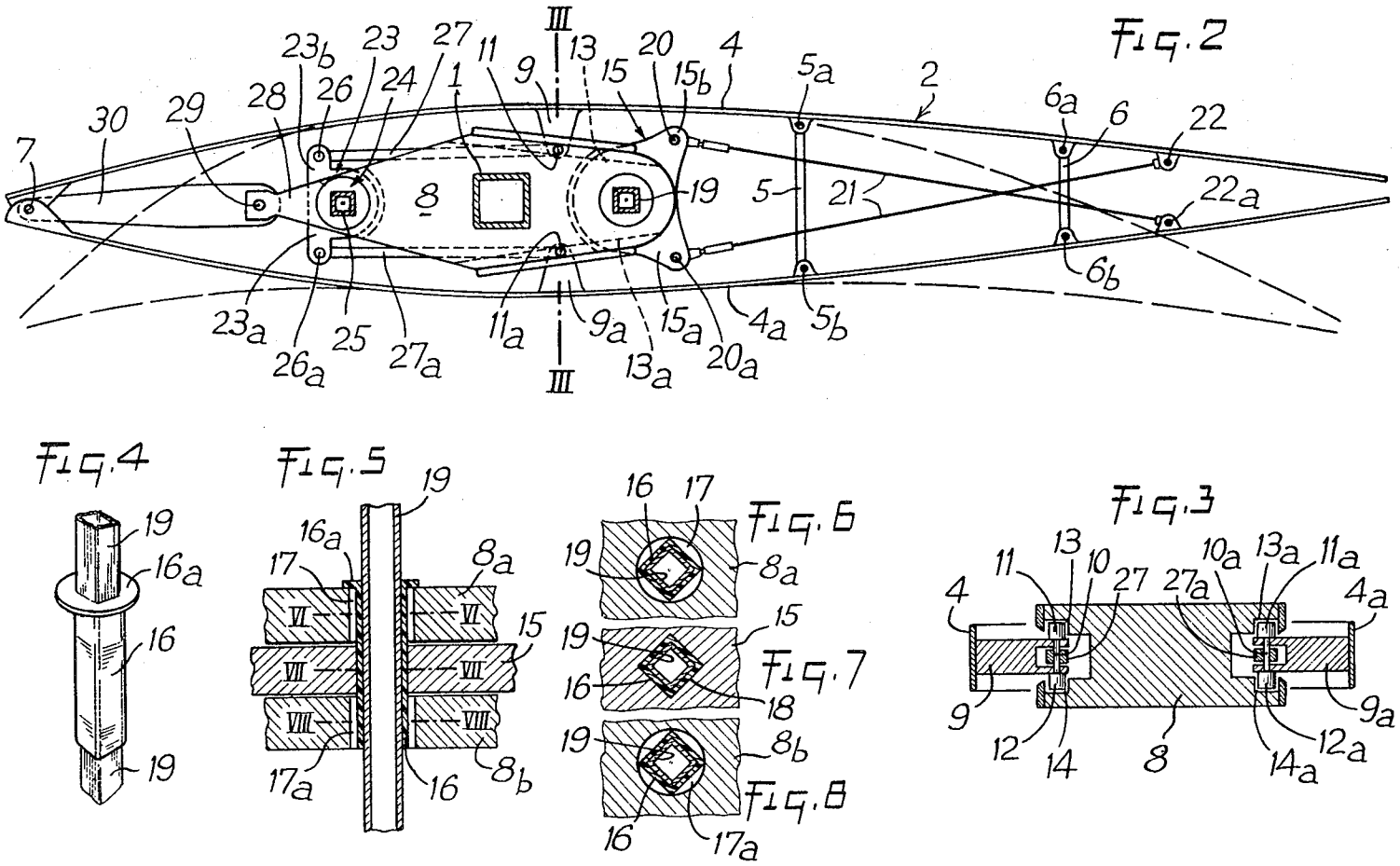
FIG. 2 is a plan view of a rib in a sail assembly according to the invention.
FIG. 3 is a cross-sectional view along line III—III of FIG. 2.
FIG. 4 is a perspective view of the sleeve mounted on the slide piece and surrounding the cam shaft.
FIG. 5 is a cross-sectional view of a cam and of the slide piece at the level of the cam shaft.
FIG. 6 is a cross-sectional view along line VI—VI of FIG. 5.
FIG. 7 is a cross-sectional view along line VII—VII of FIG. 5.
FIG. 8 is a cross-sectional view along line VIII—VIII of FIG. 5.

The mast 1 and the cam shafts 19 and 25 (FIG. 1) are driven in rotation at their base by driving members 31, 32 and 33 and by pairs of gear wheels 34, 35 and 36 or by any other known transmission means. The sail assembly according to the invention works as follows. To alter the incidence of the sail assembly in relation to the relative wind, the motor 31 is actuated, said motor ensuring the rotation of the mast 1 and of the rib assembly 2, 2*a* of the sails via the pair of gears 34. To alter the profile of the sail assembly, it is necessary to alter the profile of the ribs which, in the normal position, is biconvex as shown in FIG. 2. But the sail assembly can be modified so as to have a flat profile or a hollow profile, as shown in broken lines in FIG. 2. The cams 15 are actuated by rotating the shaft 19, said cams transmitting their movement via the rods 21, 21*a* to the rear part of the laths 4, 4*a* to alter the rear part of the ribs 2, 2*a*.

The cam 23 and the small rods 27, 27*a* are actuated by rotating the shaft 25, said cam and small rods transmitting their movement via the lugs 9, 9*a* to the front part of the laths, in order to alter the profile of the front part of the ribs. The arrangement is such that the profile can be altered whatever the position of the mast 1 and the incidence of the sails.

To alter the profile of the front part of the ribs 2, 2*a*, it is also possible to replace the tension rod 30 by another rod of different length.

The invention is in no way limited to the description given hereinabove and on the contrary covers any modifications that can be brought thereto without departing from the scope thereof.

What is claimed is:

1. Sail assembly of variable profile, reversible and collapsible, comprising a mast on which are mounted ribs set apart one from the other, each one being constituted of two flexible laths joined together by means of hinge members, the said ribs being covered with a supple material, such as for example sail cloth, an assembly wherein each rib comprises a slide piece on which the two laths are pivotally mounted and on which a mast is slidably mounted, said mast being fast in rotation with said slide and being adapted to be driven in rotation, the said slide piece being provided at the back with a first cam which is fast with a shaft driven in rotation and which comprises two arms connected by transmission members pivotally mounted on the rear portion of the flexible laths, said slide piece being provided at the front with a second cam which is fast with a shaft driven in rotation and which comprises two arms connected by small rods to the pivoting axles of the flexible laths on the slide piece, and said slide piece being joined at the front by way of a tension rod to a pivoting point on the front part of the two flexible laths.

2. Sail assembly as claimed in claim 1, wherein the said slide piece is provided in its center and on either side of its longitudinal axis with two pairs of grooves, in each one of which moves a pair of runners fast with an axle on which is pivotally mounted a lug integral with the middle part of each flexible lath and a small rod connected to the second cam situated at the fore end.

3. Sail assembly as claimed in claim 1, wherein, at the level of each rib, are provided sleeves which are fast in rotation with each cam and which are mounted for free rotation in the slide piece, said sleeves being fast in rotation with the respective driven shafts.

4. Sail assembly as claimed in claim 3, wherein said sleeves are of polygonal cross-section and are engaged in a polygonal hole in each cam and in holes of circular cross-section provided in the slide piece, each said sleeve presenting a flange which rests against the slide piece and engages its said driven shaft of corresponding polygonal cross-section with which it is fast in rotation.

5. Sail assembly as claimed in claim 1, wherein the mast and the cam shafts are each driven in rotation by a driving member.

* * * * *